US010063011B2

(12) United States Patent
Wanner

(10) Patent No.: US 10,063,011 B2
(45) Date of Patent: Aug. 28, 2018

(54) MULTIPLE PINS OF DIFFERENT LENGTHS CORRESPONDING TO DIFFERENT DATA SIGNALING RATES

(71) Applicant: HEWLETT PACKARD ENTERPRISE DEVELOPMENT LP, Houston, TX (US)

(72) Inventor: Christopher C. Wanner, Houston, TX (US)

(73) Assignee: Hewlett Packard Enterprise Development LP, Houston, TX (US)

( * ) Notice: Subject to any disclaimer, the term of this patent is extended or adjusted under 35 U.S.C. 154(b) by 0 days.

(21) Appl. No.: 15/500,065

(22) PCT Filed: Mar. 4, 2015

(86) PCT No.: PCT/US2015/018733
§ 371 (c)(1),
(2) Date: Jan. 30, 2017

(87) PCT Pub. No.: WO2016/140659
PCT Pub. Date: Sep. 9, 2016

(65) Prior Publication Data

US 2017/0244198 A1 Aug. 24, 2017

(51) Int. Cl.

| | |
|---|---|
| ***H01R 13/66*** | (2006.01) |
| ***H01R 13/641*** | (2006.01) |
| ***H01R 13/6474*** | (2011.01) |
| ***H01R 13/04*** | (2006.01) |

(52) U.S. Cl.
CPC ..... *H01R 13/641* (2013.01); *H01R 13/04* (2013.01); *H01R 13/6474* (2013.01); *H01R 13/6691* (2013.01)

(58) Field of Classification Search
CPC .... H01R 13/641; H01R 13/6581; H01R 9/03; H01R 12/714; H01R 12/724; H01R 13/6474; H01R 13/6691; H01R 13/04
USPC ..... 439/620.21
See application file for complete search history.

(56) References Cited

U.S. PATENT DOCUMENTS

| | | | | |
|---|---|---|---|---|
| 4,059,332 | A | 11/1977 | Phillips et al. | |
| 5,176,528 | A * | 1/1993 | Fry | H01R 12/724 439/181 |
| 6,056,573 | A * | 5/2000 | Nishioka | H01R 12/714 235/441 |
| 6,351,392 | B1 | 2/2002 | Palaniappa | |
| 6,942,511 | B1 | 9/2005 | Orsley | |
| 7,300,313 | B1 * | 11/2007 | Whiteman, Jr. | H01R 9/03 439/358 |

(Continued)

FOREIGN PATENT DOCUMENTS

| | | |
|---|---|---|
| JP | 2008041656 | 2/2008 |
| JP | 2012174597 | 9/2012 |

OTHER PUBLICATIONS

International Search Report and Written Opinion; PCT/US2015/018733; dated Nov. 27, 2015; 12 pages.

(Continued)

*Primary Examiner* — Jean F Duverne
(74) *Attorney, Agent, or Firm* — Hewlett Packard Enterprise Patent Department

(57) ABSTRACT

Examples disclose an electrical connector comprising a first pin and a second pin. Each pin has a different length corresponding to a different data signaling rate.

17 Claims, 5 Drawing Sheets

(56) References Cited

U.S. PATENT DOCUMENTS

| | | | | |
|---|---|---|---|---|
| 7,448,917 | B2 | 11/2008 | Liao et al. | |
| 7,914,303 | B2 | 3/2011 | Amleshi et al. | |
| 2007/0099467 | A1 | 5/2007 | Jager et al. | |
| 2009/0298324 | A1 | 12/2009 | Liu | |
| 2010/0126754 | A1 | 5/2010 | Koga | |
| 2016/0087377 | A1* | 3/2016 | Toba ..... | H01R 13/6581<br>439/620.22 |

OTHER PUBLICATIONS

Roland S. Timsit; High Speed Electronic Connectors: a Review of Electrical Contact Properties, (Web Page); Aug. 1, 2005;14 pages.

* cited by examiner

MULTIPLE PINS OF DIFFERENT LENGTHS CORRESPONDING TO DIFFERENT DATA SIGNALING RATES

BACKGROUND

An electrical network fabric is a term to describe a network topology in which components pass data to each other through an interconnection of devices such as connectors and/or switches. As such, the networking fabric spreads network traffic across multiple physical links to route data and/or traffic accordingly.

BRIEF DESCRIPTION OF THE DRAWINGS

In the accompanying drawings, like numerals refer to like components or blocks. The following detailed description references the drawings, wherein.

DETAILED DESCRIPTION

High speed electrical based fabrics may continue in the foreseeable future for routing traffic and/or data across a connector. Determining whether the fabric link and/or connector is capable of supporting a desired data rate prevents a customer from experiencing link errors that could impact quality service and result in data corruption. As such, these high speed networking fabrics may require that the fabric and other connectors operate across certain minimum requirements for reliable operations.

The use of a "presence" pin allows a system to determine whether a signal pin is connected or disconnected; however this "presence" pin may not account for a signal integrity degradation that may result from the connector not being fully mated. Design engineers may assume that a connector is fully connected or mated even when the connection is not visible; however this is not the case as mechanical tolerances and stack-ups of an enclosure may prevent the connection from being fully mated. If the connection is not fully mated, a system may be unable to handle the data signaling rate for reliable operations.

Some examples provide a connector including a first pin and a second pin. Each pin is a different length and as such corresponds to a different data signaling rate. Upon a coupling of at least one of these pins, the connector can detect the data signaling rate correlated the particular pin. The use of these pins in combination allows a controller determine the connector capability beyond detection of a presence. As such, determining the data signaling rate in which the connector may handle provides reliability and prevents link errors that would affect quality of server. Additionally, detecting the data signaling rate in which the connector may handle, verifies a signal integrity strength between the pins and associated contacts.

Other examples determine a quality of connection between the pins and the electrical contacts. Determining the quality of connection indicates whether that connection is partially disconnected or fully disconnected. For example, if the connection in a particular fabric link exhibits excessive bit errors or other type of connectivity errors, determining whether the issue is result of a degradation in the quality of a connection may lead to a more rapid resolution of the connectivity issue. This ensures the pins are fully connected or mated to the electrical contacts.

Yet, other examples determine an amount of de-mate space between the pins and the contacts. Determining the amount of de-mate space, enables the controller to determine the amount of de-mate space to determine the data signaling rates upon partial disconnection of the connector.

As such, the examples provide a mechanism in which to determine a data signaling rate capability for a connector. Determining the data signaling rate, the connector provides reliable operations in handling traffic.

Figure 1:
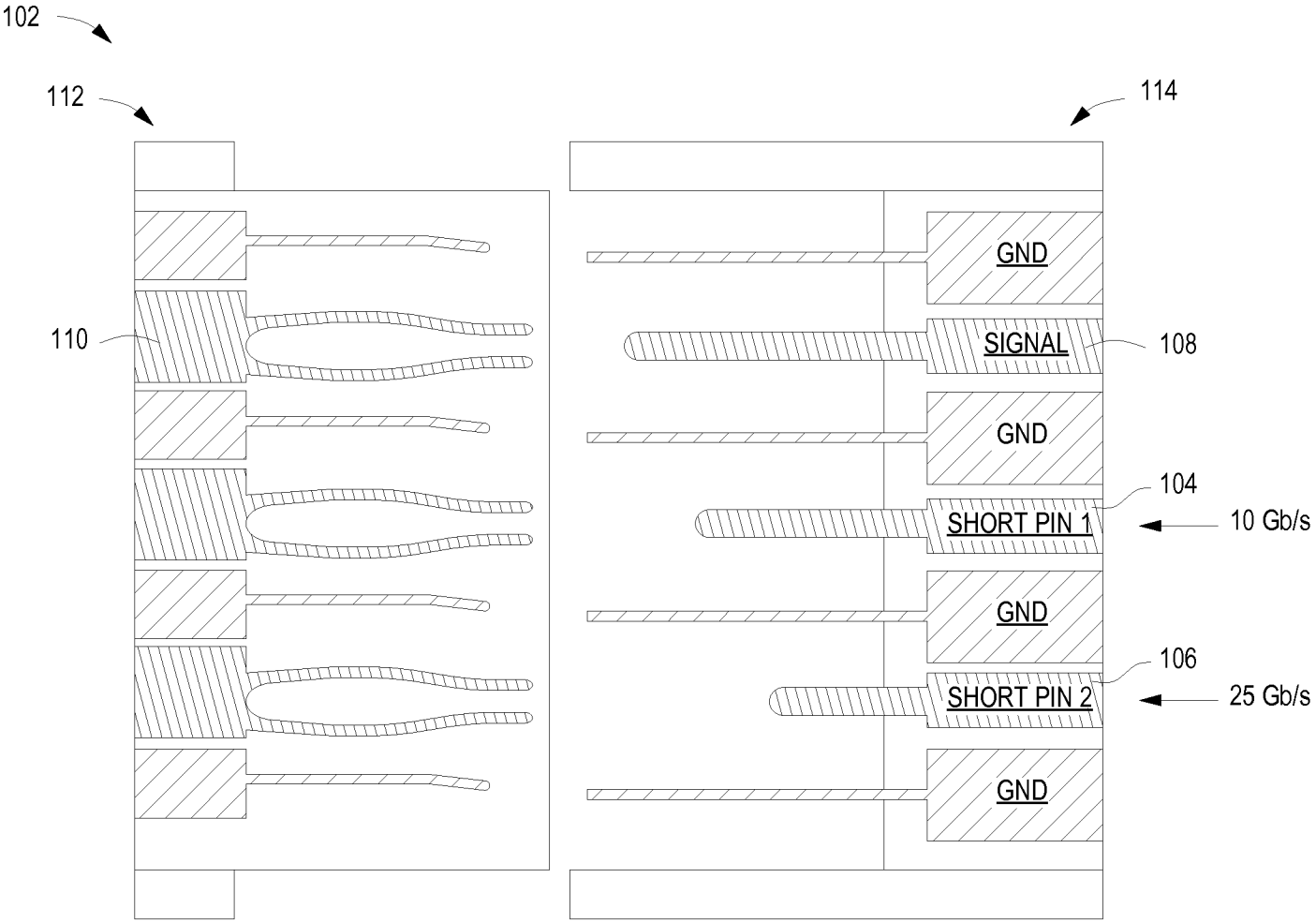
FIG. 1 is a block diagram of an example electrical connector including a first pin and a second pin, each pin a different length and corresponds to a different data signaling rate.

Referring now to the figures, FIG. 1 is a block diagram of an example connector 102 including connector halves of a male portion 114 and a female portion 112. The male portion 114 includes a first pin 104 and a second pin 106. Each of these pins 104 and 106 are a different length which corresponds to a different signaling rate (e.g., 10 Gb/s and 25 Gb/s). At least one of these pins 104 and 106 connects to an electrical contact 110 on the female portion 112 for the connector 102 to detect the corresponding data signaling rate.

FIG. 1 illustrates a variety of multiple pin lengths provide for full capability of determining which data signaling rate the connector 102 is able to handle. As illustrated in FIG. 1, the male portion 112 of the connector 102 includes three different pin lengths between the first pin 104, second pin 106, and the signaling pin 108. The longest length pin, the signaling pin 108, is used for actual signals themselves. That is, the signaling pin 108 is used to carry the signals at the data speed corresponding to the first pin 104 and/or the second pin 106. The middle length pin, the first pin 104, is set at a lower data speed than the second pin 106. The shortest length pin, the second pin 106, is set at a length which would correlate to the signal integrity supported by a higher data signaling rate. The use of these pins 104, 106, and 108 in combination allow the connection system to determine the connector 102 capability beyond just detecting a presence.

The data signaling rates (e.g., 25 Gb/s and 10 Gb/s) correlate to the various lengths of the first pin 104 and the second pin 106. The data signaling rate is the aggregate rate at which data passes a point in a transmission path. In this instance, the data signaling rate is the rate at which an amount of data passes through the connector 102, thus completing the networking fabric. The data signaling rate may be expressed as bits per second (b/s) throughout the document. Additionally, the data signaling rate may be expressed as a data rate, data speed, networking speed, networking rate, etc. Although FIG. 1 illustrates the first and the second pins 104 and 106 as correlated to the particular data rates of 25 Gb/s and 10 Gb/s, respectively, these pins 104 and 106 may correspond to other various particular data rates, such as 35 Gb/s and 5 Gb/s, etc.

The connector 102 is considered part of the networking fabric which data and/or traffic is routed through, accordingly. The connector 102 is considered an electro-mechanical device which joins together circuits as an interface using a mechanical assembly. As such, the connector 102 comprises the male portion 114 in which to join to the female portion 112. In other implementations, the connector 102 may further include a controller (not illustrated) to detect the coupling of at least one of the pins 104 and 106 to the associated contact(s) 110. In this manner, the connector 102 may referred to as the connection system.

The first pin 104 and the second pin 106 are electrical connector pins as part of the male portion 114 of the connector 102. The first pin 104 and the second pin 106 may be comprised of a variety of material which allow a flow of electrons between these pins 104 and 106 and the electrical contact 110 upon coupling. To create the attachment between the pins 104 and 106 and the male portion 114 of the connector, the pins 104 and 106 are pressed into a non-conductive material which comprises the male portion 114. In this implementation, the pins 104, 106, and 108 are pressed into the non-conductive material when the material is in a moldable state. Thus, when this non-conductive material hardens, the pins 104, 106, and 108 become an integral part of the male portion 114 of the connector 102. In turn, this male portion 114 of the connector 102 may be press-fit into and/or soldered onto a printed circuit board (PCB).

The first and the second pins 104 and 106 utilize specific lengths different from each other and from other pins 108 in the connector 102. The different lengths of the first pin 104 and the second pin 106 allow these pins 104 and 106 to correlate to the particular data rates. The various lengths of these pins 104 and 106 determine at a gross level whether the male portion 114 is connected to the female portion 112 of the connector 102 and whether the connector 102 can handle the particular data rates. Upon at least one of the first pin 104 and the second pin 106 being coupled or connected to the associated contact(s) 110, a logic high signal or logic low signal is generated. This signal is monitored by a controller (not illustrated) to determine which of the pins 104 and 106 are in connection, thus allow the controller to detect which particular data rate the connector 102 is capable of handling. This implementation is discussed in detail in a later figure. As such, the first pin 104 and the second pin 106 operate independently of the ground pins (GND) and other signaling pins 108 which transmit data. Additionally, although FIG. 1 illustrates two multiple pins 104 and 106 as corresponding to the different data signaling rates as including 10 Gb/s and 25 Gb/s, this was done for illustration purposes. For example, FIG. 1 may further include three or more multiple pins, each pin corresponding to a different data signaling rate.

The signaling pin 108, located on the male portion 114 of the connector 102, provides the data to the female portion 112 of the connector 102. In this manner, the connection of the signaling pin 108 to the female portion 112 is the pin used to carry the actual data through the connector 102.

The electrical contact(s) 110 located on the female portion 112 of the connector 102, enables a coupling or contact between at least one of the pins 104 and 106. As such, to allow this contact, the electrical contact(s) 110 may be compromised of a material which allows the flow of electrons from the pins 104 and 106 to the contact 110.

The female portion 112 of the connector 102 includes the contact(s) which coupled to the pins 104, 106, and/or 108 on the male portion 114 of the connector 102. The female portion 112 may include various numbers of individual rows of contacts. In one implementation, the female portion 112 of the connector 102 includes a receptacle portion and is considered part of a server blade.

The male portion 114 of the connector 102 includes the pins 104, 106, and 108 for providing contact with the female portion 112 of the connection 102. Accordingly, the male portion 114 may include various number of individual rows of pins. In one implementation, the male portion 114 of the connector 102 includes a header portion and is considered part of a mid-plane or back plane as part of the enclosure that a server of server blade may be plugged into.

Figure 2A:
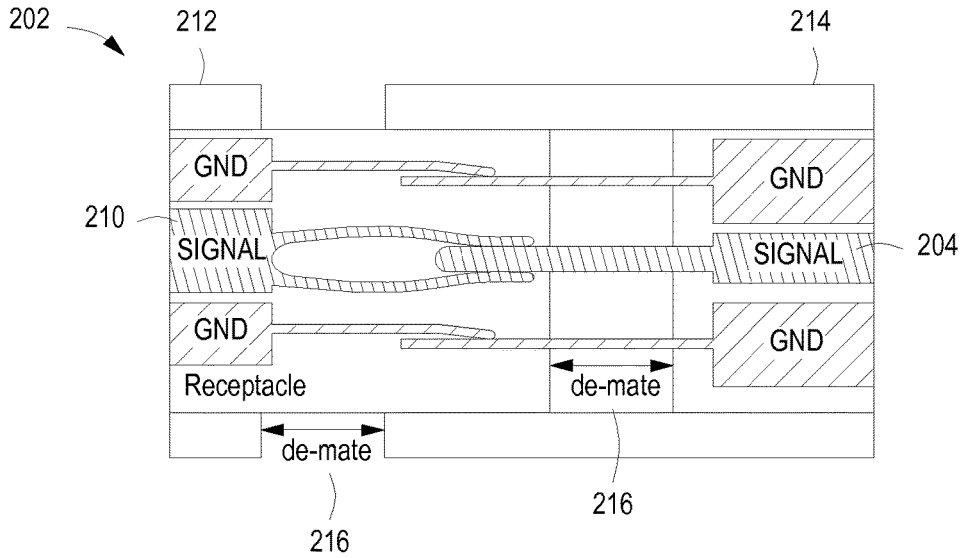
FIG. 2A is a block diagram of an example connector depicting a mated connection of a pin with a small amount of de-mate space.
Figure 2B:
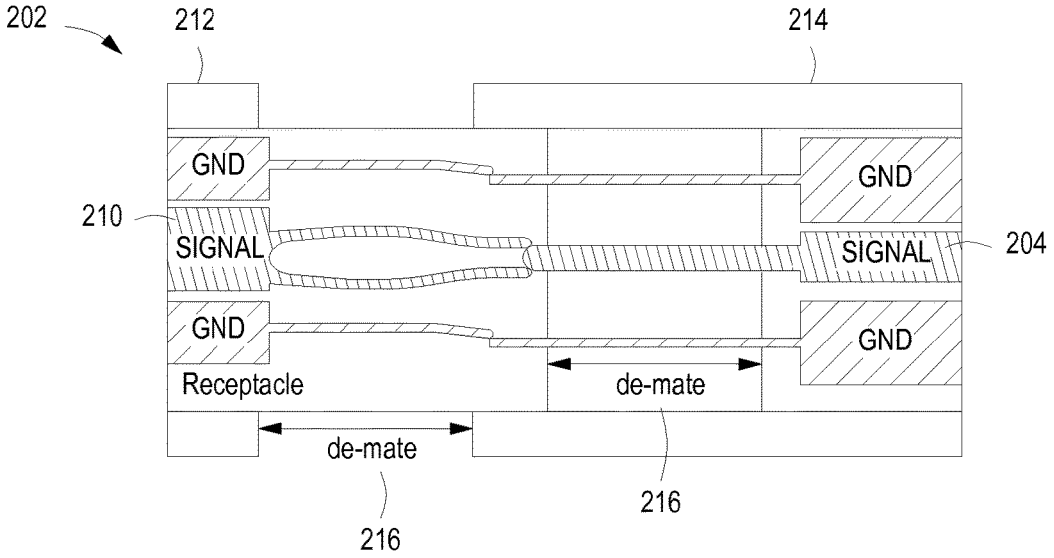
FIG. 2B is a block diagram of an example connector depicting a mated connection of a pin to a contact with a large amount of de-mate space between the pin and the contact.

FIGS. 2A-2B illustrates various amounts of de-mating space 216 between a pin 204 and an associated contact 210 in a connector 202. In this manner, the various amounts of de-mating space 216 allows a controller (not illustrated) to detect a quality of the coupling. The quality of the coupling indicates how connected or how disconnected the male portion 214 of the connector 202 is to the female portion 212. The quality of the coupling decreases as the de-mate space 216 increases. As such, these figures represent the situations in which the pin 204 may not be fully seated and thus the quality of the coupling decreases. As such, FIG. 2A represents a partial de-mate or partial mate between the pin 204 and a corresponding electrical contact 210. FIG. 2B represents the amount of de-mate space 216 large enough that the pin 204 is barely in contact with the electrical contact 210. As such, FIG. 2B represents the larger amount of partial de-mate that may occur just prior to full de-mate when this is no longer a connection with the pin 204 and the associated electrical contact 210. A signal integrity impairment as propagated through the connector 202 is directly related to the amount of de-mate space 216. That is, as the de-mate space 216 increases from FIG. 2A to FIG. 2B the signal integrity impairments become more pronounced and the signal integrity of the connector 202 decreases. For example, if the female portion 212 and the male portion 214 of the connector 202 are fully seated or fully mated, the connector 202 may be able to reliably handle 25 Gb/s. However, this full mating may decrease to the partial de-mate as in FIG. 2A to the point where the connector may be only able to reliably handle 10 Gb/s. Further de-mating as in FIG. 2B can result in the connector 202 being able to reliably handle speeds under 10 Gb/s. This process of the signal integrity degradation continues until the connector 202 is de-mated so that electrical signals may be unable to be propagated through the connector 202. Although FIGS. 2A-2B illustrate the pin 204, this was done for illustration purposes as the connector 202 should further include a second pin (not illustrated) of different length from the pin 204. Accordingly, each of these pins correspond to a different data signaling rates or data speeds. This is discussed in detail in the next figure.

FIG. 2A illustrates the situation of a partial de-mate space 216. The de-mate space 216 is the amount of by which the connector 202 halves (e.g., the male portion 214 and the female portion 212) are not fully mated. In this implementation, the second pin may be shorter in length than the pin 204 and as such, the pin 204 may be mated to the contact 210 while the second pin may remain unmated or disconnected from an associated contact on the female portion 212 of the connection 202. Thus, the pin 204 that is connected to the electrical contact 210 indicates that the connector 202 is capable of operation at the data signaling rate corresponding to the connected pin 204. As such, this connected pin 204 operates independently of the ground pins (GND) and other signaling pins which transmit data.

Upon the connection of the pin 204 to the electrical contact 210, a connection system detects the amount of de-mate space through a pull-up side on the female portion 212 of the connector 202 while the male portion 214 is connected to ground. In this implementation, the connection system monitors the pin 204 for a logic high signal or a logic low signal. If the connection system determines the signal is logic low, this indicates the pin 204 is mated to the female portion 212 of the connector 202. If the connection system determines the signal is logic high, this indicates the pin 204 is unconnected to the female portion 212 of the connector 202. This implementation is discussed in detail in the next figure.

FIG. 2B represents an amount of de-mate space 216 in which the air space between mating of the pin 204 to the contact 210 is great enough that the pin 204 is in the partial de-mate state. This partial de-mate represents the amount of de-mate space that may occur prior to full de-mate in which there is no longer the coupling between the pin 204 and the contact 210. Upon the full de-mate, an electrical signal may be unable to propagate through the pin 204 to the contact 210. When a full de-mate occurs, a logic high signal is received upon the decoupling or de-mating of the pin 204 to the contact 210 an in turn the female portion 212 of the connector 202. The logic high signal indicates a larger impedance and thus a larger amount of de-mate space 216 between the pin 204 and the contact 210. This implementation is discussed in detail in the next figure.

Figure 3:
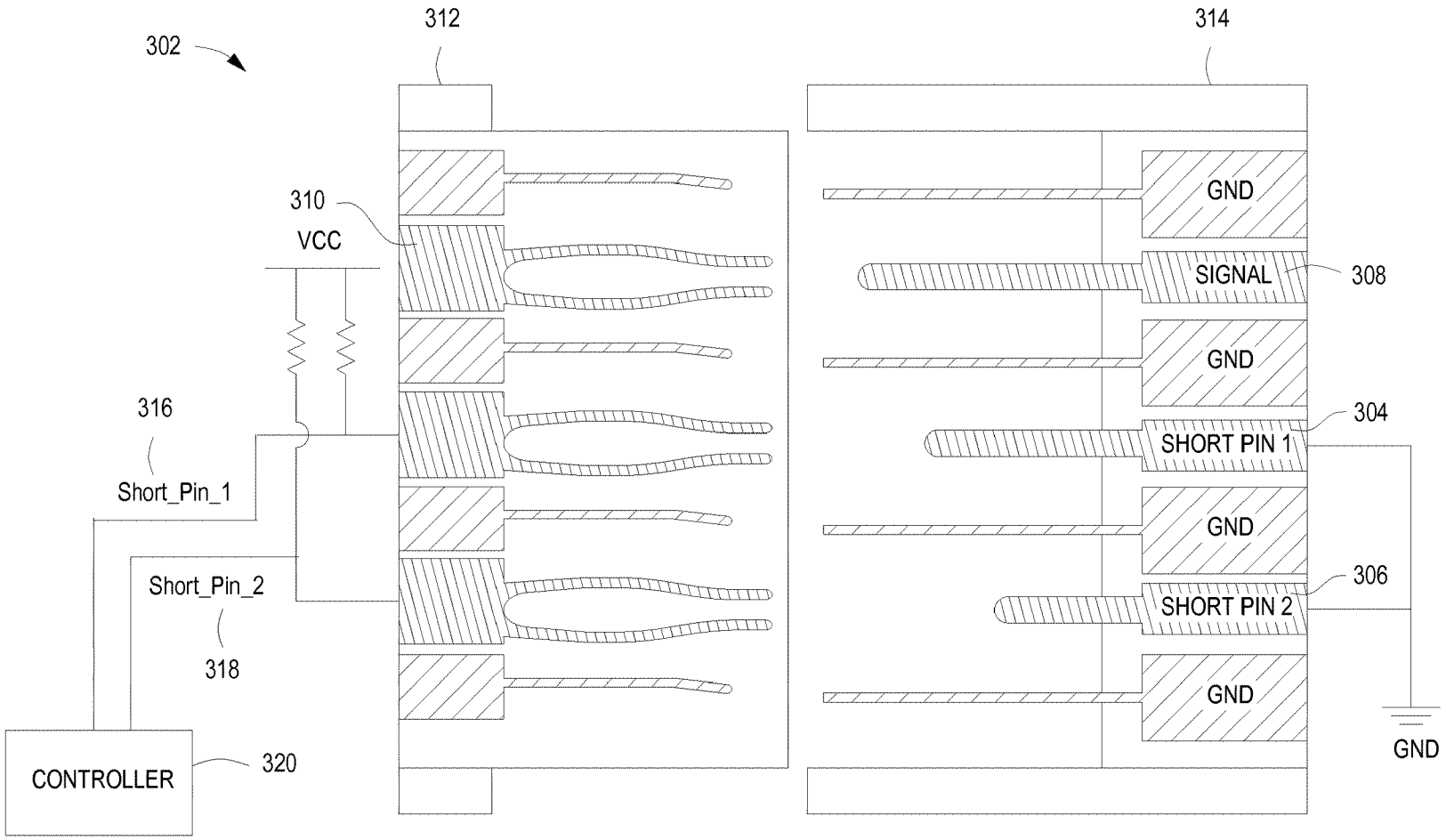
FIG. 3 is a block diagram of an example apparatus including a male portion of multiple pins and a female portion of multiple contacts.

FIG. 3 is a diagram of an example connector 302 including a male portion 314 of multiple pins 304 and 306 and a female portion 312 of multiple contacts 310. In this figure, the multiple pins 304 and 306 (Short Pin 1 and Short Pin 2) correspond to various data signaling rates to transmit data on a signal pin 308. Depending on which of the multiple pins 304 and 306 are mated to the contacts 310, produce signals 316 and/or 318 representing "Short_Pin_1" and "Short_Pin_2" for a controller 320 to receive and determine which data signaling rate the connector 302 is capable of handling. In an implementation, the female side 312 of the connector 302 includes a receptacle portion of the connector 302 while the male side 314 of the connector 302 includes a header portion as connected to a mid-plane or backplane of a server.

As illustrated in FIG. 3, the female side 312 of the connector 302 is a pull-up side including various resistors connected to a voltage greater than ground (Vcc). The pull-up side includes the connector 302 which provides the intelligence of the connection system. As such, the controller 320 receives a logic high signal or logic low signal in response to the connection or disconnection of at least one of the multiple pins 304 or 306. The logic high is a higher impedance signal indicating a greater amount of de-mate space while the low signal is a lower impedance signal indicating a connection between the particular pin 304 and 306 and corresponding contact 310. Although FIG. 3 illustrates the pull-up resistors and controller 320 located on the female side 312 of the connector 302, implementations should not be limited as the pull-up resistors and controller 320 may be on the male side 314 of the connector 302.

Producing the low signal or high signal in accordance with the connection between the pins 304 and 306 and the contacts 310, enables the controller 320 monitors these signals 316 and 318 (Short_Pin_1 and Short_Pin_2) on the female side 312 of the connector 302. In an example, the controller 320 monitors the signals 316 and 318 in a pre-boot and/or post-boot environment of a server blade. Monitoring the signals in the pre-boot and post-boot environment, allows the controller 320 to determine a speed of the data signaling rate in in which the connector 302 is capable of operation. Further, this allows the controller 320 to debug connectivity issues of the connector 302. In this implementation, of both of the multiple pins 304 and 306 corresponding to the data speed rates are found to produce a low signal on Short_Pin_1 316 and Short_Pin_2 318, this tells the connector 302 both of the multiple pins 304 and 306 are coupled and thus the connector 302 is capable for operation at the corresponding data rates. For example, assume the first pin 304 (Short Pin 1) corresponds to a slower data rate such as 10 Gb/s and the second pin 306 (Short Pin 2) corresponds to a higher data rate such as 25 Gb/s. In this example, if the controller 320 reads both of these pins 304 and 306 are fully mated to the contacts 310 on the female side 312, this indicates the connector 302 is capable of speeds up to the 25 Gb/s. If the first pin 304 is found to produce a low signal, but the second pin 306 is found to produce a high signal, then this indicates to the controller 320 the connector 302 is mated for reliable operation at the slower data rate of 10 Gb/s. If both the first pin 304 and the second pin 306 are found to produce the high signal, this indicates to the controller 320 the connector is unable to handle either data speed rates of 25 Gb/s and 10 Gb/s. Observing these pins 304 and 306 in a pre-boot environment and/or post-boot environment, the system connector qualifies the connectivity of the connector and fabric link for the appropriate data rate. This further enables the controller 320 to inform a customer of these connectivity issues.

Figure 4:
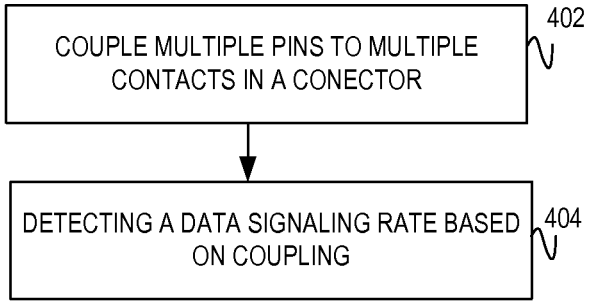
FIG. 4 is a flowchart of an example method to couple multiple pins to multiple contacts in a connector for detecting a data signaling rate based on the coupling.

FIG. 4 is a flowchart of an example method in which multiple pins are coupled to multiple contacts in a connector. Each of the multiple pins correlates to a different length of pin. The different length of each pin in turn corresponds to a different networking rate. Upon mating at least one of the multiple pins to the multiple contacts, a controller receives a signal indicating which different length pin was connected and in turn which data signaling rate is supported. The method in FIG. 4 is executable by a computing device and as such may include a processor and/or controller to execute operations 402-404. For example, the processor may execute operations 402-404 to detect a specific data signaling rate. In another example, the controller may execute operations 402-404 to detect the specific data signaling rate. In discussing FIG. 4, references may be made to the components in FIGS. 1-3 to provide contextual examples. For example, at least one of the pins 104 and 106 in FIG. 1 may couple to one of the contacts 110 for the controller to detect the corresponding data signaling rate (e.g., 10 Gb/s or 25 Gb/s).

At operation 402, the multiple pins are coupled to the multiple contacts in the connector. The connector includes pins of various pin lengths, each pin length corresponds to a particular data rate. Thus, the coupling between at least one of the multiple pins and the multiple contacts produce a connection of such a quality that the controller verifies if a fabric link associated with the connector is capable of handling the particular data rate. In this manner, each of the multiple pins correspond to different lengths. Thus, upon the coupling of at least one of these multiple pins, the controller picks up the signal as either logic high or logic low. The logic high or logic low signal determines more precisely an amount of de-mate space between the coupled pin(s) to the contact(s). Thus, this signal indicates the signal integrity of the coupling such that the signal qualifies or disqualifies the ability of that connector to support the data rate as a function of the pin being mated to the contact. In implementations, the connection may be of such a quality as to verify which particular data signaling rates may be handled by the connector. In these implementations, the coupling may include a fully mated connection, a partial connection, or fully de-mated connection. For example in one implementation, the coupling may include the fully mated or fully seated connection. The fully mated connection is a connection in which each of the multiple pins are connected to each of the corresponding contacts. The fully mated connection indicates that the connector is capable of supporting or handling each of the corresponding data signaling rates. In another implementation, the coupling may be partially mated or partially de-mated, meaning at least one of the multiple pins is in contact with at least one of the contacts while another one of the pins is not in contact with the corresponding contact. The partial mating or partial connection indicates the connector is able to support a slower data networking signal. For example, in the partial mating implementation, the shortest pin may be one of the initial pins to be disconnected from the contact. The shortest length pin may correspond to a higher networking signal rate, thus the longer length pin among the multiple pins may correspond to the slower networking signal rate. Thus, the longer length pins may still be connected to the contact while the shorter length pin remains uncoupled. In a further implementation, the coupling may include the full disconnection. In this implementation, none of the multiple pins corresponding to the various data signaling rates are in contact with the electrical contacts. The disconnection indicates that connector is unable to handle or support the data signaling rates corresponding to the pins.

At operation 404, upon which of the multiple pins are coupled to the multiple contacts in the connector, the controller detects the data signaling rate. Operation 404 provides a mechanism for the controller to determine whether a fabric link associated with the connector is able to support the specific data rate corresponding to the coupled pin. This prevents a link error if the fabric link is unable to handle the specific data rate. As such, the controller may receive the signal from the coupled pin which indicates which of the multiple pins may be connected to the electrical contacts.

Figure 5:
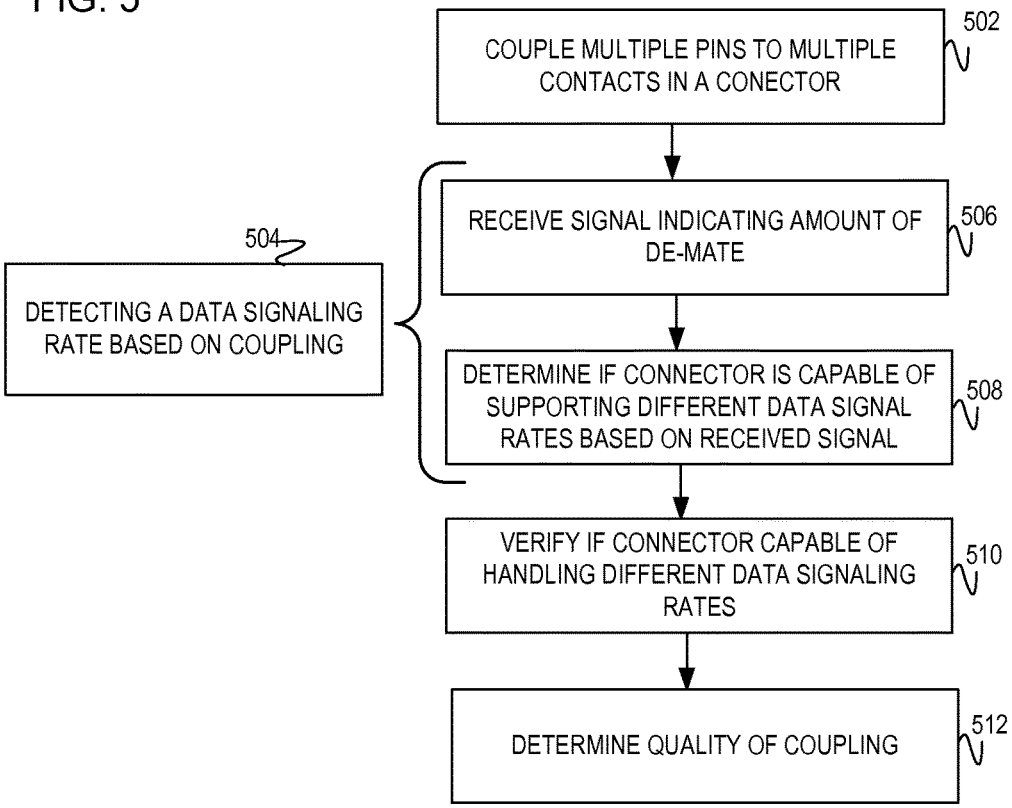
FIG. 5 is a flowchart of an example method to detect a data signaling rate based on a quality of coupling between multiple pins and multiple contacts in a connector.

FIG. 5 is a flowchart of an example method to detect a data signaling rate based on a quality of coupling between a pin and a contact in a connector. Upon coupling at least one the multiple pins to the corresponding contact(s), the method detects the data signaling rate. The data signaling rate may be detected by receiving a signal which may indicate an amount of de-mate space. Upon receiving the signal, the method proceeds to determine if the connector within a fabric link is capable of supporting the data signaling rate. This capability may be dependent on which of the multiple pin(s) are connected to the corresponding contact(s). The method in FIG. 5 is executable by a computing device and as such may include a processor and/or controller to execute operations 502-512. For example, the processor may execute operations 502-512 to detect a specific data signaling rate based on the quality of the coupling. In another example, the controller may execute operations 502-512 to detect the specific data signaling rate. In discussing FIG. 5, references may be made to the components in FIGS. 1-3 to provide contextual examples. For example, at least one of the pins 104 and 106 in FIG. 1 may couple to one of the contacts 110 for the controller to detect the corresponding data signaling rate (e.g., 10 Gb/s or 25 Gb/s).

At operation 502, at least one of the multiple pins is coupled to the corresponding contact(s). Each of the multiple pins correspond to different data signaling rates, thus depending on which multiple pin(s) are coupled to the contact(s) determines whether the connector is capable of handling the specific data rate. Operation 502 may be similar in functionality to operation 402 as in FIG. 4.

At operation 504, the controller detects the data signaling rate corresponding to the coupled multiple pin(s). In one implementation, the controller detects which data signaling rate corresponding to the coupled multiple pin(s) by proceeding to operations 506-508 to receive the signal and determine if the connector is capable of the detected data signaling rate. Operation 504 may be similar in functionality to operation 404 as in FIG. 4.

At operation 506, the controller receives the signal indicating an amount of de-mate space between the multiple pins and the multiple contacts. The data signaling rate may be detected by receiving as signal which may indicate the amount of de-mate space. For example, the signal may be a logic high indicating a larger amount of de-mate space and thus higher impedance level. In another example, the signal may be a logic low indicating a lesser amount of de-mate space and thus a lower impedance level. For example, the amount of de-mate space is the area of space between the contacts and pins which is exposed to the air. Thus in this implementation, a partially de-mated configuration a portion of the electrical contacts are still connected to a portion of the multiple contacts. The resulting characteristics may be different than a fully mated configuration. The changes in these resulting characteristics may be the results of the amount of de-mate space which is exposed to air, thus the impedance of the partially mated configuration increases. Thus at operation 506, an amount of signal integrity impairment exhibited by the connector in a de-mated or partially de-mated condition is directly related to the amount of de-mate. That is, as the de-mate space increases the signal integrity impairments become pronounced. For example, if the connector may handle 25 Gb/s while the multiple pins are fully mated to the multiple contacts, may degrade to 10 Gb/s under partial de-mate. This results in the connector being able to handle 10 Gb/s or less. This process of signal integrity may continue until the connector is fully de-mated so no signal may be propagated through the connector.

At operation 508, the controller determines if the connector is capable of supporting the detected data signaling rate based on the received signal at operation 506. Alternatively upon detecting which of the multiple pin(s) coupled to the multiple contacts, the controller verifies whether the connector is capable of handling the detected data signaling rate at operation 510. In another alternative rather than proceeding to operation 510, the controller proceeds to operation 512 to verify whether the connector is capable of handling the different data signaling rates corresponding to the coupled multiple pin(s).

At operation 510, the controller verifies whether the connector is capable of handling the different data signaling rates corresponding to the multiple pins. As explained in connection with operation 506, the amount of signal integrity impairment exhibited by the connector indicates the data signaling rate the connector may handle. For example, in the fully mated situation, the connector may handle the highest data signaling rate, while in the de-mated or partially de-mated condition, the connector may handle the lower data signaling rates. The rates the controller may be capable of handle is dependent on the condition of the mating of the multiple pins are to the electrical contacts. These conditions may include the fully mated configuration, partially de-mated configuration, or fully de-mated configuration.

At operation 512, the controller determines the quality of the coupling between the multiple pins and the multiple contacts based on the received signal. The quality of the coupling indicates the amount of the de-mate space between the multiple pins and the multiple contacts. For example, the quality may include whether the connector is fully mated, partially mated, partially de-mated, or fully de-mated.

What is claimed is:

1. An electrical connector comprising:

a first pin having a first length that corresponds to a first data transmission rate;

a second pin having a second length that corresponds to a second data transmission rate that is different from the first data transmission rate; and a third pin that delivers data at a transmission speed of either first data transmission rate or the second data transmission rate based on a de-mate space between a different electrical connector and the first pin and the second pin.

2. The electrical connector of claim 1 wherein a shorter pin length among the first pin and the second pin corresponds to a higher data signaling rate.

3. The electrical connector of claim 1 comprising:

the third pin, longer in length than the first pin and the second pin, to deliver data signals at either the first data transmission rate or the second data transmission rate.

4. The electrical connector of claim 1 comprising:

a controller to receive a signal when the first pin and the second pin are partially mated to multiple contacts, the signal verifies a capability of the electrical connector to support at least one of the different data signaling rates.

5. The electrical connector of claim 1 comprising:

multiple contacts, coupled to the first pin and the second pin, wherein upon a disconnection of one of the pins to a contact indicates a slower data signaling rate between the different data signaling rates.

6. The electrical connector of claim 1 comprising:

a ground pin, located between the first pin and the third pin and longer in length than the third pin.

7. The electrical connector of claim 1 wherein the third pin that delivers data at the transmission rate of either the first data transmission rate or the second data transmission rate based on the de-mate space between the different electrical connector and the first pin and the second pin comprises:

a controller, coupled to the different electrical connector, to:

detects an amount of the de-mate space between a connection of the electrical connector to the first pin and the second pin.

8. A method comprising:

coupling multiple contacts to multiple pins in a connector, each of the multiple pins are a different length corresponding to a different data transmission rates; and detecting which data transmission rate among the different data transmission rates has been implemented based on an amount of de-mate space between multiple pins on different connectors.

9. The method of claim couple to the 8 wherein detecting which data transmission speed has been implement based on the amount of de-mate space between pins on different connectors comprises:

receiving a signal indicating an amount of the de-mate space between the multiple pins on a first connector and multiple pins on a second connector; and determining that the first connector and the second connector are capable of supporting the different data transmission speeds based on the received signal.

10. The method of claim 9 comprising:

determining a quality of the coupling between the multiple pins and the multiple contacts based on a received signal, the quality indicative of amount of de-mate space between the multiple pins on the first connector and the second connector.

11. The method of claim 10 comprising:

verifying that the first connector and the second connectora are capable of handling the different data signaling rates corresponding to the multiple pins.

12. The method of claim 8 wherein a shortest pin length among the multiple pins corresponds to a higher data signaling rate and a longer pin length among the multiple pins corresponds to a lower data rate.

13. An electrical apparatus comprising:

a male portion of a first electrical connector comprising:

a first pin and a second pin, each pin multiple pins of different lengths and corresponding to a different data transmission rates;

a third pin to deliver data at the data transmission rate of the first pin or the second pin based on an amount of de-mate space between the first and second pin and multiple contacts on a female portion of a second electrical connector; and the female portion of the second electrical connector comprising:

multiple contacts to connect to the pins of the male portion of the first electrical connector wherein the connection between each of the multiple contacts to each of the first pin and the second pin indicates which data signaling rate is supported by the electrical connector.

14. The electrical apparatus of claim 13 comprising:

a mid-plane to support the male portion of the electrical connector; and a server blade to support the female portion of the electrical connector.

15. The electrical apparatus of claim 13 comprising:

a controller, coupled to the female portion of the second electrical connector, to receive a low signal in response to the first pin and the second pin being fully mated to the multiple contacts.

16. The electrical apparatus of claim 13 comprising:

a controller, coupled to the female portion of the electrical connector, to receive a high impedance signal in response to the amount of de-mate space between the multiple pins and the multiple contacts.

17. The electrical apparatus of claim 13 wherein a shortest pin length among the multiple pins corresponds to a highest data signaling rate.

* * * * *